US009062559B2

(12) United States Patent
Little

(10) Patent No.: US 9,062,559 B2
(45) Date of Patent: Jun. 23, 2015

(54) MOVABLE STRUT COVER FOR EXHAUST DIFFUSER

(75) Inventor: David A. Little, Chuluota, FL (US)

(73) Assignee: Siemens Energy, Inc., Orlando, FL (US)

( * ) Notice: Subject to any disclaimer, the term of this patent is extended or adjusted under 35 U.S.C. 154(b) by 950 days.

(21) Appl. No.: 13/195,910

(22) Filed: Aug. 2, 2011

(65) Prior Publication Data

US 2013/0031913 A1 Feb. 7, 2013

(51) Int. Cl.

| | |
|---|---|
| ***F04D 29/30*** | (2006.01) |
| ***F01D 17/16*** | (2006.01) |
| ***F01D 25/16*** | (2006.01) |
| *F04D 29/24* | (2006.01) |

(52) U.S. Cl.

CPC ..... *F01D 17/162* (2013.01); *F01D 17/16* (2013.01); *F04D 29/30* (2013.01); *F04D 29/24* (2013.01); *F01D 25/162* (2013.01); *F05D 2270/17* (2013.01); *F05D 2250/90* (2013.01)

(58) Field of Classification Search

USPC ..... 60/226.1, 226.3, 228, 230, 232, 770, 60/771, 796, 797; 415/142, 148, 151, 159, 415/160, 161, 126, 224, 914, 150, 211.2; 416/231 R, 231 B, 90 R, 91

See application file for complete search history.

(56) References Cited

U.S. PATENT DOCUMENTS

| | | | | |
|---|---|---|---|---|
| 2,805,818 | A * | 9/1957 | Ferri | 415/148 |
| 3,318,574 | A * | 5/1967 | Tyler | 415/36 |
| 3,887,297 | A * | 6/1975 | Welchek | 415/161 |
| 3,990,810 | A * | 11/1976 | Amos et al. | 415/161 |
| 4,053,256 | A * | 10/1977 | Hertel | 415/161 |
| 4,097,187 | A | 6/1978 | Korta | |
| 4,172,361 | A * | 10/1979 | Kronogard | 60/791 |
| 4,989,406 | A | 2/1991 | Vdoviak et al. | |
| 5,311,736 | A * | 5/1994 | Lardellier | 60/226.3 |
| 5,623,823 | A * | 4/1997 | Schirle et al. | 60/226.3 |
| 6,200,092 | B1 * | 3/2001 | Koschier | 415/191 |
| 6,292,763 | B1 * | 9/2001 | Dunbar et al. | 703/7 |
| 6,435,815 | B2 * | 8/2002 | Harvey et al. | 415/115 |
| 6,715,983 | B2 | 4/2004 | Koshoffer et al. | |
| 6,792,758 | B2 | 9/2004 | Dowman | |
| 6,997,676 | B2 | 2/2006 | Koshoffer | |
| 7,114,911 | B2 * | 10/2006 | Martin et al. | 415/1 |
| 7,195,456 | B2 | 3/2007 | Aggarwala et al. | |
| 7,464,536 | B2 * | 12/2008 | Renggli et al. | 60/204 |
| 8,016,567 | B2 * | 9/2011 | Praisner | 416/231 R |
| 8,347,633 | B2 * | 1/2013 | Smith et al. | 60/771 |
| 2006/0034689 | A1 | 2/2006 | Taylor et al. | |
| 2007/0119150 | A1 | 5/2007 | Wood et al. | |
| 2010/0061846 | A1 * | 3/2010 | Herbst et al. | 415/200 |
| 2010/0158684 | A1 | 6/2010 | Baralon | |
| 2010/0303607 | A1 | 12/2010 | Orosa | |

* cited by examiner

*Primary Examiner* — Phutthiwat Wongwian
*Assistant Examiner* — Michael B Mantyla

(57) ABSTRACT

A strut cover for use in a gas turbine engine having structure defining an annular flow path for receiving exhaust gas from a turbine section of the engine. The strut cover is located downstream from a last row of blades of the turbine section and extends radially through the flow path between inner and outer walls. The strut cover includes an upstream section and a downstream section. The upstream section defines a leading edge for the strut cover and is supported on a pivot axis for pivotal movement about the pivot axis. The downstream section defines a trailing edge for the strut cover and includes an upstream end positioned adjacent to a downstream end of the upstream section. The downstream section is stationary relative to the inner and outer walls to define a predetermined flow angle for directing exhaust gases flowing from the upstream section and passing through the diffuser.

17 Claims, 4 Drawing Sheets

MOVABLE STRUT COVER FOR EXHAUST DIFFUSER

FIELD OF THE INVENTION

The invention relates in general to turbine engines and, more particularly, to a structure for controlling flow through an exhaust diffuser for a turbine engine.

BACKGROUND OF THE INVENTION

A gas turbine engine generally includes a compressor section, a combustor section, a turbine section and an exhaust section. In operation, the compressor section inducts and compresses ambient air. The compressed air from the compressor section is directed to one or more combustors in the combustor section where it is mixed with the fuel and combusted to form a hot working gas. The hot working gas is routed to the turbine section where it is expanded through alternating rows of stationary airfoils and rotating airfoils and used to generate power that can drive a rotor. The expanded gas exiting the turbine section is exhausted from the engine via the exhaust section.

The exhaust section may be configured as a diffuser defined as annular divergent duct formed between inner and outer walls. The exhaust diffuser operates to reduce the speed of the exhaust flow and thus increase the pressure difference of the exhaust gas expanding across the last stage of the turbine. In addition, support struts may extend through the inner and outer walls to support a bearing housing radially inwardly from a casing surrounding the diffuser. Typically, the support struts are surrounded by covers or aerodynamic fairings to direct gas flow around the support struts and to protect the support struts from the hot working gases.

In current power plant operations, the power output from a gas turbine engine may be reduced from a base load operating condition, such as may be provided during a high power grid energy demand, to a part load operating condition, such as may occur during a reduced power grid energy demand during which power from a generator driven by the turbine engine may not be required. During part load operation, the turbine engine is typically operating at an efficiency that is below an optimum design efficiency provided during the base load operation.

SUMMARY OF THE INVENTION

In accordance with one aspect of the invention, a strut cover is provided for use in a gas turbine engine having structure defining an annular flow path for receiving exhaust gas from a turbine section. The structure includes an inner annular wall and an outer annular wall, and including a casing for housing the structure. The strut cover is located downstream from a last row of blades of the turbine section and extends radially through the flow path between the inner wall and the outer wall. The strut cover includes an upstream section defining a leading edge for the strut cover and including a downstream end. The upstream section is supported on a pivot axis for pivotal movement about the pivot axis. The strut cover additionally includes a downstream section defining a trailing edge for the strut cover and includes an upstream end positioned adjacent to the downstream end of the upstream section. The downstream section is stationary relative to the inner and outer walls to define a predetermined flow angle for directing exhaust gases flowing from the upstream section and passing through the diffuser.

In accordance with further aspects of the invention, the upstream section may be pivotally movable to orient a chordal axis of the upstream section to angles relative to a central axis of the engine that generally match an angle of incidence of gases flowing from the last row of blades of the turbine section. The upstream section may be pivotally movable to angles between about +10 degrees and about −45 degrees.

The upstream section may include side walls that diverge in a direction extending from the leading edge, and the downstream section may include side walls that converge in a direction extending toward the trailing edge. The downstream end of the upstream section and the upstream end of the downstream section may define cooperating nested convex and concave surfaces extending between the side walls. A seal may be located between the downstream end of the upstream section and the upstream end of the downstream section, and extending generally from the inner wall to the outer wall.

Inner and outer edges of the upstream section adjacent to the inner wall and outer wall, respectively, each may be formed with a spherical surface for generally conforming to the shape of the respective inner and outer walls during pivotal movement of the upstream section.

The upstream section may include a pressure side wall and a suction side wall, and the upstream section may include at least one flow channel extending from the pressure side wall to the suction side wall for transferring a portion of the exhaust gases passing though the flow path from the pressure side wall to the suction side wall. The at least one flow channel may include an inlet opening located at an upstream location along the pressure side wall, and may include an outlet opening located at a location along the suction side wall downstream from the upstream location. The outlet opening may be defined by a passage extending generally parallel to the suction side wall at the outlet opening to energize a boundary layer formed by exhaust gas flowing adjacent to a suction side wall of the downstream section.

In accordance with another aspect of the invention, a strut cover is provided for use in a gas turbine engine having structure defining an annular flow path for receiving exhaust gas from a turbine section. The structure includes an inner annular wall and an outer annular wall, and including a casing for housing the structure. A bearing compartment housing for a rotor shaft bearing is located radially inwardly from the inner annular wall. At least one support strut extends from the casing to the bearing compartment housing for supporting the bearing compartment housing. A strut cover is located downstream from a last row of blades of the turbine section, and the strut cover extends radially through the flow path between the inner wall and the outer wall. The strut cover includes an upstream section defining a leading edge for the strut cover and includes a downstream end. The upstream section is supported on a pivot axis for pivotal movement about the pivot axis. The strut cover additionally includes a downstream section defining a trailing edge for the strut cover and includes an upstream end positioned adjacent to the downstream end of the upstream section. The downstream section surrounds the support strut and is stationary relative to the inner and outer walls to define a predetermined flow angle for directing exhaust gases flowing from the upstream section and passing through the diffuser.

In accordance with an additional aspect of the invention, the outer annular wall may diverge radially outwardly in a downstream direction from the strut cover.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiment, reference is made to the accompanying drawings that form a part hereof, and in which is shown by way of illustration, and not by way of limitation, a specific preferred embodiment in which the invention may be practiced. It is to be understood that other embodiments may be utilized and that changes may be made without departing from the spirit and scope of the present invention.

Figure 1:
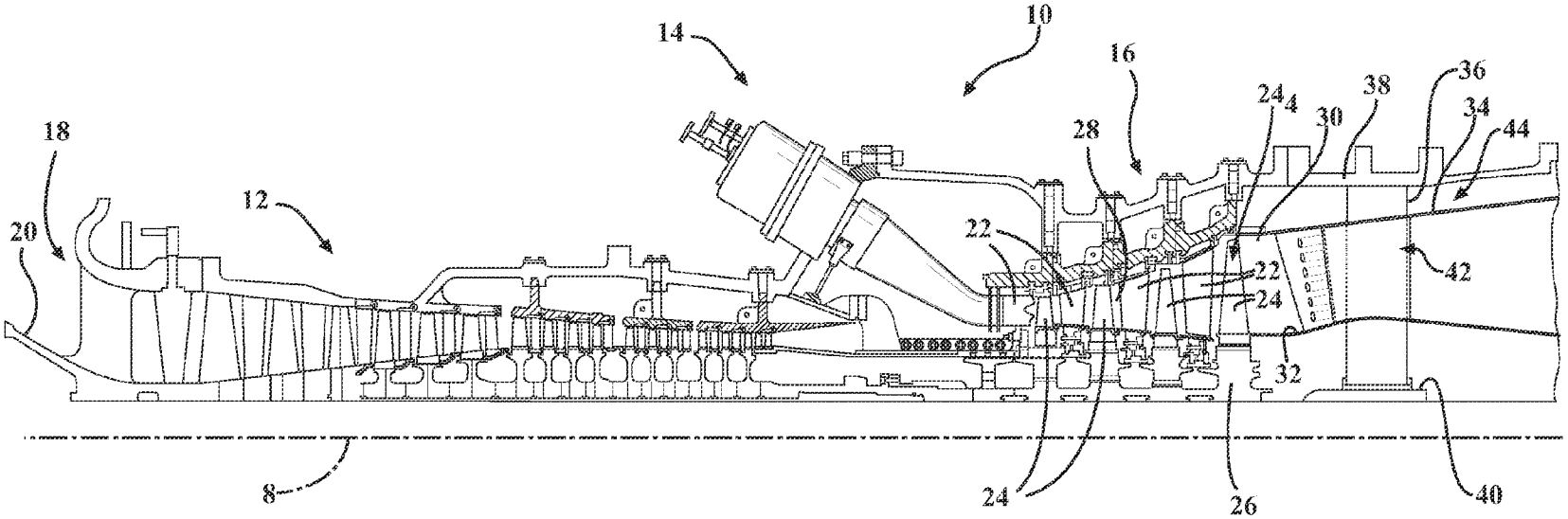
FIG. 1 is a partial cross-sectional view of a gas turbine engine incorporating a strut cover in accordance with aspects of the present invention.

Referring to FIG. 1, an axial flow gas turbine engine 10 is diagrammatically illustrated including a compressor section 12, a combustor section 14, and a turbine section 16 arranged about a central longitudinal axis 8 of the engine 10. The compressor section 12 compresses ambient air 18 that enters an inlet 20. The combustor section 14 combines the compressed air with a fuel and ignites the mixture creating combustion products comprising a hot working gas defining a working fluid. The working fluid travels to the turbine section 16. Within the turbine section 16 are rows of stationary vanes 22 and rows of rotating blades 24 coupled to a rotor 26, each pair of rows of vanes 22 and blades 24 forming a stage in the turbine section 16. The rows of vanes 22 and rows of blades 24 extend radially into an axial flow path 28 extending through the turbine section 16. The working fluid expands through the turbine section 16 and causes the blades 24, and therefore the rotor 26, to rotate. The rotor 26 extends into and through the compressor 12 and may provide power to the compressor 12 and output power to a generator (not shown).

The expanded working fluid flows from the turbine section 16 through structure defining an annular flow path 30. The structure defining the annular flow path 30 includes an inner annular wall 32 and an outer annular wall 34 spaced radially outwardly from the inner annular wall 32. The structure formed by the inner and outer annular walls 32, 34 is surrounded by an outer casing 38 of the engine 10.

A bearing compartment housing 40 for a rotor shaft bearing (not shown) is located radially inwardly from the inner wall 32. A plurality of circumferentially spaced support struts 36 (only one shown in FIG. 1) extend radially from the outer casing 38 and pass through the outer wall 34 and inner wall 32 to support the bearing compartment 40.

Figure 2:
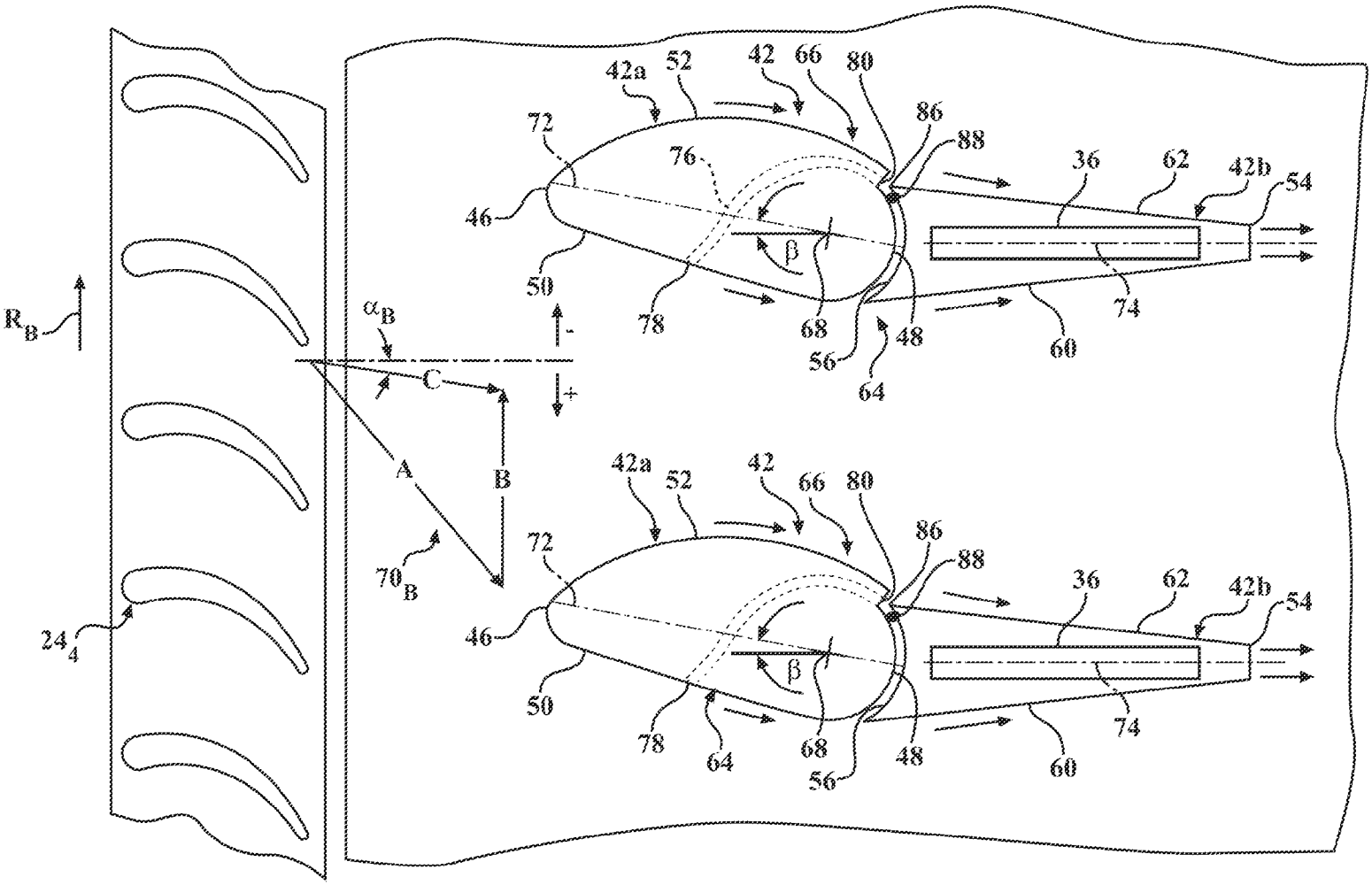
FIG. 2 is a diagrammatic plan view of a portion of the exhaust for a turbine section of the turbine engine illustrating the strut cover in accordance with an aspect of the invention.

Referring additionally to FIG. 2, in accordance with an aspect of the invention, a strut cover 42 extends radially through the flow path 30 between the inner and outer walls 32, 34. The strut cover 42 is positioned over the support strut 36 to direct gas flow around the support strut 36 and to protect the support strut 36 from the hot working gases flowing from the last turbine blade row $\mathbf{24}_4$ of the turbine section 16 to a diffuser section 44 (FIG. 1) defined by the flow path 30 and including the inner and outer annular walls 32, 34. As is discussed further below, the strut cover 42 is configured as an adaptable or reconfigurable structure which, in accordance with an aspect of the invention, improves the efficiency of the turbine section 16 as operating conditions of the engine change from, for example, a base load operation to a part load operation.

During engine operation, as the hot working gases flow through the turbine section 16, the total pressure of the gases drops generally linearly as it passes through the successive stages defined by the pairs of rows of vanes 22 and blades 24. The exhaust gases exit the last blade row $\mathbf{24}_4$ with significant velocity. However, the diffuser section 44 provides a deceleration of the exhaust gases with an associated pressure recovery. Hence, the diffuser section 44 contributes to providing an optimum thermodynamic efficiency for the engine.

The diffuser section 44 is configured to provide a predetermined deceleration of the exhaust gases based in part on a predetermined mass flow of the exhaust gases in the axial direction. In addition, the exhaust gases generally have a substantial circumferential velocity component, or swirl component, which tends to reduce the efficiency of the pressure recovery provided by the diffuser section 44. That is, the diffuser section 44 is configured to function at a greater efficiency to recover pressure when the flow of exhaust gases generally flow through the diffuser with a minimal circumferential component, The exhaust gases flowing from the last blade row $\mathbf{24}_4$ pass between the strut covers 42, which substantially counteract or deswirl the flow of exhaust gases, causing it to flow in a substantially axial direction thereby recovering the pressure of the gases that otherwise would be primarily lost as they flow from the last blade row $\mathbf{24}_4$.

The incidence angle of the incoming exhaust flow will vary depending on the circumferential component of velocity imparted to the working gas as it passes through the rows of rotating blades 24. The circumferential velocity component may vary considerably as a function of engine power. Hence, in accordance with an aspect of the invention, the strut covers 42 are configured to redirect the exhaust gases across a wide range of incidence angles, and in particular to redirect the exhaust gas along a generally axial direction defined by the downstream section 42*b* by reducing or minimizing aerodynamic separation at the strut covers 42 to facilitate the flow directing function of the strut covers 42, as is described further below.

Referring to FIG. 2, the strut cover 42 includes an upstream section 42*a* and a separate downstream section 42*b*. The upstream section 42*a* defines a leading edge 46 and a generally convexly shaped downstream end 48. The upstream section 42*a* includes opposing side walls comprising a pressure side wall 50 and a suction side wall 52 extending from the leading edge 46 in diverging relation to each other in the downstream direction. The suction side wall 52 is formed as a generally convexly shaped wall extending between the leading edge 46 and the downstream end 48, and the pressure side 50 is formed as a relatively flatter side extending between the leading edge 46 and the downstream end 48.

Figure 4:
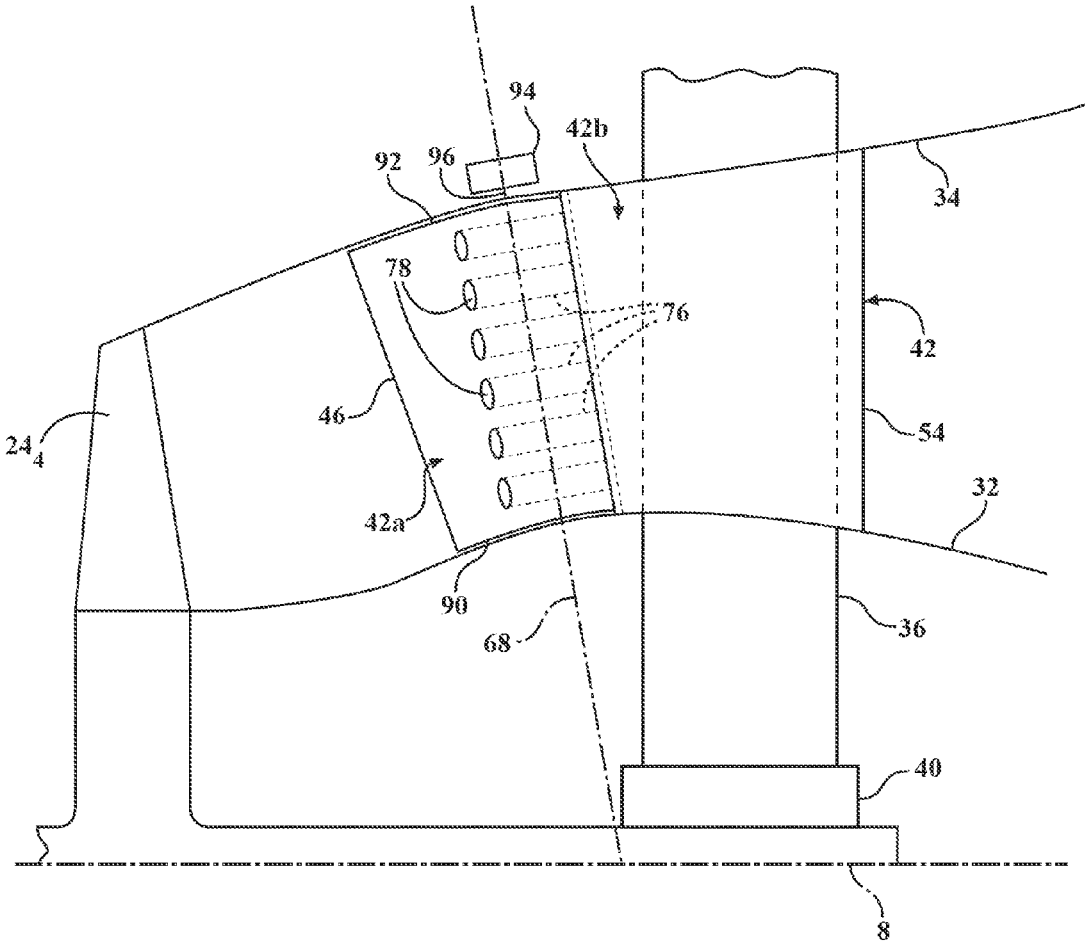
FIG. 4 is a diagrammatic elevational view of a portion of the exhaust for the turbine section of the turbine engine further illustrating the strut cover.

The downstream section 42*b* defines a trailing edge 54 and a generally concavely shaped upstream end 56 positioned closely adjacent to the downstream end 48 of the upstream section 42*a*. The convexly shaped downstream end 48 generally matches or conforms to and is nested within the concavely shaped upstream end 56. The upstream section 42*a* comprises a movable section, and is supported for pivotal movement about a pivot axis 68, as seen in FIG. 4. The convexly curved surface 48 of the upstream section 42*a* may have a curvature with a generally constant radius centered on the pivot axis 68, such that the convexly curved surface 48 remains nested within the concavely curved surface 56 of the downstream section 42*b* during pivotal movement of the upstream section 42*a*.

Referring to FIG. 2, the downstream section 42*b* includes opposing side walls comprising a pressure side wall 60 and a suction side wall 62 extending from the upstream end 56 toward the trailing edge 54 in converging relation in the downstream direction. In the illustrated configuration, the pressure and suction side walls 60, 62 may be formed as generally planar walls or may be formed with a convex configuration extending between the upstream end 56 and the trailing edge 54. The upstream section 42*a* and downstream section 42*b* pressure and suction side walls 50, 60 and 52, 62 form generally continuous strut cover pressure and suction sides 64, 66, respectively.

It should be noted that the terms "pressure side" and "suction side", as used herein, refer to pressures that may be generally present at the sides 64, 66 of the strut cover 42 as a result of exhaust gas flow off the last blade row $\mathbf{24}_4$ during rotation of the last blade row $\mathbf{24}_4$ in the direction of rotation $R_B$ depicted in FIG. 2. However, it should be understood that the terminology employed herein is not intended to be limiting with regard to particular relative pressures present on the opposing sides 64, 66 of the strut cover 42.

Referring further to FIG. 2, a vector diagram $\mathbf{70}_B$ illustrates the orientation of an exhaust gas flow from the last blade row $\mathbf{24}_4$ during base load operation of the turbine engine 10. Vector A in FIG. 2 represents the mass flow of the exhaust gases relative to the last blade row $\mathbf{24}_4$, vector B represents the rotational velocity of the last blade row $\mathbf{24}_4$, and vector C is the resultant vector of vectors A and B. In particular, vector C is representative of the exhaust gas flow flowing toward the strut covers 42 at an incidence angle $\alpha_B$ relative to the central longitudinal axis 8 of the turbine engine 10. For example, during base load operation, the exhaust gas from the last blade row $\mathbf{24}_4$ may flow at an angle of about +10 degrees toward the strut covers 42, where angles with a negative sign indicate a direction in the circumferential direction of blade rotation $R_B$.

In accordance with an aspect of the invention, the upstream section 42*a* may be pivoted about its pivot axis 68 to align a chordal axis 72 of the upstream section 42*a* generally parallel to the flow vector C of the incident exhaust gases. That is, the upstream section 42*a* may be pivoted to an angle β of about +10 degrees. As a result of the alignment of the upstream section 42*a* with the exhaust gas flow, the exhaust gas flow may generally follow the contours of the side walls 50, 52 of the upstream section 42*a*, i.e., flow along the upstream section 42*a* without, or with reduced, separation and/or without substantial formation of vortices at the side walls 50, 52. Further, the generally attached flow along the side walls 50, 52 of the upstream section 42*a* may facilitate attached flow along the side walls 60, 62 of the downstream section 42*b*. It may be noted that the chordal axis 74 of the downstream section 42*b* may be generally aligned with the central longitudinal axis 8 of the turbine engine. Hence, the exhaust gas flow passing downstream from the side walls 60, 62 may be generally aligned to the axially aligned chordal axis 74 of the downstream section, and to the engine axis 8, to a greater extent by providing a guided path that initially aligns with the incident flow. Providing an axially directed flow of the exhaust gases with a reduced circumferential component provides a flow that may be decelerated at a higher efficiency through the diffuser section 44 that may provide an improved pressure recovery with an associated increase in efficiency for the turbine section 16.

Figure 3:
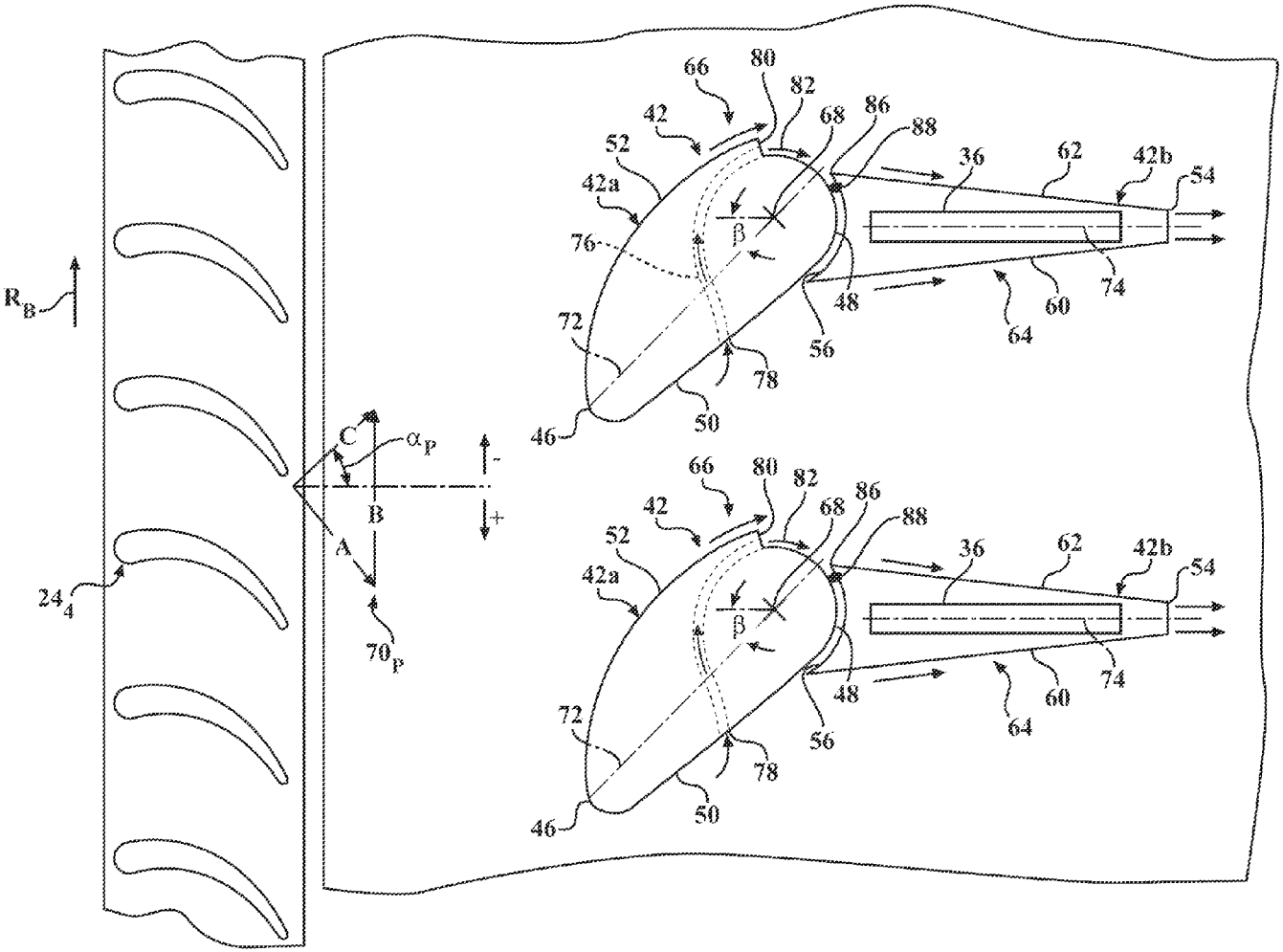
FIG. 3 is a diagrammatic plan view of a portion of the exhaust for the turbine section of the turbine engine illustrating the strut cover in accordance with a further aspect of the invention.

Referring to FIG. 3, a vector diagram $\mathbf{70}_P$ illustrates the orientation of an exhaust gas flow from the last blade row $\mathbf{24}_4$ during a part load operation of the turbine engine 10. For example, the vector C in the vector diagram $\mathbf{70}_P$ may represent the flow of exhaust gases incident on the flow covers 42 during operation of the turbine engine 10 at a reduced power, such as at about 40% or less of the power output of the turbine engine 10 during base load operation.

During part load operation, a much stronger circumferential component relative to the axial component is imparted to the exhaust gas flow by the last blade row $\mathbf{24}_4$, such that the exhaust gas from the last blade row $\mathbf{24}_4$ may flow at an angle of about −45 degrees toward the strut covers 42. The upstream section 42*a* may be pivoted about its axis 68 to an angle β of about −45 degrees to align the chordal axis 72 of the upstream section 42*a* generally parallel to the flow vector C of the incident exhaust gases. As a result of the alignment of the upstream section 42*a* with the exhaust gas flow, the exhaust gas flow may generally follow the contours of the side walls 50, 52 of the upstream section 42*a*, i.e., flow along the upstream section 42*a* without, or with reduced, separation and/or without substantial formation of vortices at the side walls 50, 52.

In accordance with a further aspect of the invention, the upstream section 42*a* may include one or more flow channels 76 extending from an inlet opening 78 on the pressure side wall 50 to an outlet opening 80 at a location on the suction side wall 52 downstream from the inlet opening 78. The flow channels 76 transfer a portion of the exhaust gases passing through the flow path 30 from the pressure side wall 50 to the suction side wall 52, and the outlet openings 80 are defined by end passages of the flow channels 76 that extend generally parallel to the suction side wall 52. The portion of the exhaust gases passing though the flow channels 76 may form a gas jet or discharge flow 82 that exits to flow at a location downstream of the upstream section 42*a*. In particular, the discharge flow 82 is directed to flow along the suction side wall 62 of the downstream section 42*b* and may be discharged generally parallel to the flow of exhaust gases passing over the suction side wall 52 of the upstream section 42*a* adjacent to the outlet opening 80 to energize a boundary layer flow adjacent to the suction side wall 62 of the downstream section 42*b*. Hence, the exhaust gas flow following the contour of the suction side wall 52 of the upstream section 42*a* may be energized to further generally follow the contour of the suction side wall 62 of the downstream section 42*b*. Energizing the flow adjacent to the suction side wall 62 operates to limit or reduce formation of vortices and facilitates attachment of flow of the exhaust gases to follow the contour of the suction side wall 62. The downstream section 42*b* defines a predetermined flow angle for directing exhaust gases flowing from the upstream section 42*a* and passing through the diffuser section 44, such as to direct the exhaust gases to flow generally aligned with the central longitudinal axis 8 of the turbine engine 10.

It may be noted that during the base load operation, as illustrated by FIG. 2, the pressures on the pressure and suction side walls 60, 62 of the downstream section 42*b* may be substantially equal, such that the exhaust gas flow may tend to flow in a direction parallel to the chordal axis 74 without requiring an energizing flow from the outlet openings 80 of the flow channels 76. Therefore, in the position of FIG. 2, an outer edge 86 of the upstream end 56 of the downstream section 42*b* may be located to substantially close off or prevent flow from outlet opening 80.

A seal 88 may be provided between the convex downstream end 48 and the concave upstream end 56, and extending radially between the inner and outer walls 32, 34, to substantially prevent flow of the exhaust gas between the pressure and suction sides 64, 66 at the junction of the convex and concave ends 48, 56. For example, the seal 88 may be attached to the concave end 56 of the downstream section 42*b*, and the convex end 48 of the upstream section 42*a* may slide relative to the seal 88.

Further, in order to prevent leakage of exhaust gases between an inner end 90 of the upstream section 42*a* and the inner wall 32 and between an outer end 92 of the upstream section 42*a* and the outer wall 34, the inner and outer ends 90, 92 may be contoured to conform to the respective inner and outer walls 32, 34. In particular, the inner and outer ends 90, 92 may have a curvature that generally matches the curvature of the inner and outer walls 32, 34, such as a spherical curvature to facilitate pivoting movement of the upstream section 42*a* relative to the inner and outer walls 32, 34 while substantially maintaining close positioning between the inner and outer ends 90, 92 to the inner and outer walls 32, 34 during pivotal movement of the upstream section 42*a*.

Although two particular positions of the upstream section 42*a* have been described, the upstream section 42*a* may be pivoted to selected positions within a range of positions to align with an angle of the incident exhaust gases. The upstream section 42*a* may be pivoted to the selected positions by any known driver, such as a rotational driver 94 (FIG. 4) for rotating a shaft 96 supporting the upstream section 42*a* for movement about the pivot axis 68. Also, the range of pivoted positions for the upstream section 42*a* may be within any selected range, including a range that extends beyond the particular positions described herein.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. In a gas turbine engine having a structure defining an annular flow path for receiving exhaust gas from a turbine section, the structure having a diffuser including an inner wall and an outer wall, and a casing for housing the structure, a strut cover located downstream from a last row of blades of the turbine section, the strut cover extending radially through the flow path between the inner wall and the outer wall wherein a strut extends through the strut cover from a location adjacent to the inner wall to a location adjacent to the outer wall, the strut cover including:

an upstream section defining a leading edge for the strut cover and including a downstream end, a pressure side wall, a suction side wall, and at least one flow channel extending from the pressure side wall to the suction side wall for transferring a portion of the exhaust gases passing through the flow path from the pressure side wall to the suction side wall, wherein the at least one flow channel includes:

an inlet opening located at an upstream location along the pressure side wall, and an outlet opening located at a location along the suction side wall downstream from the upstream location;

the upstream section being supported on a pivot axis for pivotal movement about the pivot axis and wherein the upstream section is pivotally movable to orient a chordal axis of the upstream section to angles relative to a central axis of the engine that generally match an angle of incidence of gases flowing from the last row of blades of the turbine section;

a downstream section defining a trailing edge for the strut cover, the strut extending through the downstream section, and including an outer edge and an upstream end positioned adjacent to the downstream end of the upstream section, the downstream section being stationary relative to the inner and outer walls to define a predetermined flow angle for directing exhaust gases flowing from the upstream section and passing through the diffuser;

wherein the upstream section includes side walls that diverge in a direction extending from the leading edge, and the downstream section includes side walls that converge in a direction extending toward the trailing edge; and the upstream section has at least two positions, one in which the outlet opening of the passage is located adjacent to the outer edge of the downstream section and a second position wherein the flow is directed in a tangential direction along the suction side.

2. The turbine engine of claim 1, wherein the upstream section is pivotally movable to angles between about +10 degrees and about −45 degrees.

3. The turbine engine of claim 1, wherein the downstream end of the upstream section and the upstream end of the downstream section define cooperating nested convex and concave surfaces extending between respective pairs of the side walls.

4. The turbine engine of claim 3, including a seal located between the downstream end of the upstream section and the upstream end of the downstream section, and extending generally from the inner wall to the outer wall.

5. The turbine engine of claim 1, wherein inner and outer edges of the upstream section adjacent to the inner wall and outer wall, respectively, are each formed with a spherical surface for generally conforming to the shape of the respective inner and outer walls during pivotal movement of the upstream section.

6. The turbine engine of claim 1, wherein the outlet opening is defined by a passage extending generally parallel to the suction side wall at the outlet opening to energize a boundary layer formed by exhaust gas flowing adjacent to a suction side wall of the downstream section.

7. The turbine engine of claim 1, wherein the position of the upstream section locating the outlet opening of the passage adjacent to the outer edge of the downstream section prevents flow from the outlet opening.

8. In a gas turbine engine having a structure defining an annular flow path for receiving exhaust gas from a turbine section, the structure having a diffuser including an inner wall and an outer wall, a casing for housing the structure, a bearing compartment housing for a rotor shaft bearing located radially inwardly from the inner wall, and at least one support strut extending from the casing to the bearing compartment housing for supporting the bearing compartment housing, a strut cover located downstream from a last row of blades of the turbine section, the strut cover extending radially through the flow path between the inner wall and the outer wall, the strut cover including:

an upstream section defining a leading edge for the strut cover and including a downstream end, a pressure side wall, a suction side wall, and at least one flow channel extending from the pressure side wall to the suction side wall for transferring a portion of the exhaust gases passing though the flow path from the pressure side wall to the suction side wall, wherein the at least one flow channel includes:

an inlet opening located at an upstream location along the pressure side wall, and an outlet opening located at a location along the suction side wall downstream from the upstream location;

the upstream section being supported on a pivot axis for pivotal movement about the pivot axis;

a downstream section defining a trailing edge for the strut cover and including an outer edge and an upstream end positioned adjacent to the downstream end of the upstream section, the downstream section surrounds the support strut and is stationary relative to the inner and outer walls to define a predetermined flow angle for directing exhaust gases flowing from the upstream section and passing through the diffuser; and wherein the upstream section has at least two positions, one in which the outlet opening of the passage is located adjacent to the outer edge of the downstream section and a second position wherein the flow is directed in a tangential direction along the suction side.

9. The turbine engine of claim 8, wherein the upstream section includes side walls that diverge in a direction extending from the leading edge, and the downstream section includes side walls that converge in a direction extending toward the trailing edge.

10. The turbine engine of claim 9, wherein the suction side wall is convexly curved from the leading edge to the downstream end.

11. The turbine engine of claim 8, wherein the outlet opening is defined by a passage extending generally parallel to the suction side wall at the outlet opening to energize a boundary layer formed by exhaust gas flowing adjacent to a suction side wall of the downstream section.

12. The turbine engine of claim 8, wherein the downstream end of the upstream section defines a convex end surface extending from the pressure side wall to the suction side wall of the upstream section, the convex end surface cooperating with a concave end surface defined in the upstream end of the downstream section and extending between the side walls of the downstream section.

13. The turbine engine of claim 12, wherein the outlet opening is located adjacent to the convex end surface of the upstream section.

14. The turbine engine of claim 8, wherein the upstream section is pivotally movable to orient a chordal axis of the upstream section to angles between about +10 degrees and about −45 degrees relative to a central axis of the engine to generally match an angle of incidence of gases flowing from the last row of blades of the turbine section.

15. The turbine engine of claim 8, wherein the outer wall diverges radially outwardly in a downstream direction from the strut cover.

16. The turbine engine of claim 8, wherein the position of the upstream section locating the outlet opening of the passage adjacent to the outer edge of the downstream section prevents flow from the outlet opening.

17. In a gas turbine engine having a structure defining an annular flow path for receiving exhaust gas from a turbine section, the structure having a diffuser including an inner wall and an outer wall, and a casing for housing the structure, a strut cover located downstream from a last row of blades of the turbine section, the strut cover extending radially through the flow path between the inner wall and the outer wall wherein a strut extends through the strut cover from a location adjacent to the inner wall to a location adjacent to the outer wall, the strut cover including:

an upstream section defining a leading edge for the strut cover and including a downstream end, a pressure side wall, a suction side wall, and at least one flow channel extending from the pressure side wall to the suction side wall, wherein the at least one flow channel includes:

an inlet opening located at an upstream location along the pressure side wall, and an outlet opening located at a location along the suction side wall downstream from the upstream location, wherein the outlet opening is defined by a passage extending generally parallel to the suction side wall at the outlet opening;

the upstream section being supported on a pivot axis for pivotal movement about the pivot axis;

a downstream section defining a trailing edge for the strut cover and including an outer edge and an upstream end positioned adjacent to the downstream end of the upstream section, the downstream section being stationary relative to the inner and outer walls to define a predetermined flow angle for directing exhaust gases flowing from the upstream section and passing through the diffuser; and wherein the upstream section has at least two positions, one in which the outlet opening of the passage is located adjacent to the outer edge of the downstream section to prevent flow from the outlet opening and a second position wherein the flow is directed in a tangential direction along the suction side.

* * * * *